US005249954A

United States Patent [19]

Allen et al.

[11] Patent Number: 5,249,954

[45] Date of Patent: Oct. 5, 1993

[54] INTEGRATED IMAGING SENSOR/NEURAL NETWORK CONTROLLER FOR COMBUSTION SYSTEMS

[75] Inventors: Mark G. Allen, Boston, Mass.; Charles T. Butler, Reston, Va.; Stephen A. Johnson, Andover, Mass.; Edmund Y. Lo, Westford, Mass.; Farla M. Russo, Brookline, Mass.

[73] Assignee: Electric Power Research Institute, Inc., Palo Alto, Calif.

[21] Appl. No.: 909,911

[22] Filed: Jul. 7, 1992

[51] Int. Cl.[5] ..... F23H 5/26

[52] U.S. Cl. ..... 431/14; 431/76; 431/75; 358/100

[58] Field of Search ..... 431/75, 76, 78, 79, 431/14; 358/100

[56] References Cited

U.S. PATENT DOCUMENTS

| | | | |
|---|---|---|---|
| 3,080,708 | 3/1963 | Carr | 431/79 |
| 4,043,742 | 8/1977 | Egan et al. | 431/79 |
| 4,410,266 | 10/1983 | Seider | 356/45 |
| 4,489,664 | 12/1984 | Williams | 110/186 |
| 4,555,800 | 11/1985 | Nishikawa et al. | 382/1 |
| 4,602,342 | 7/1986 | Gottlieb et al. | 364/498 |
| 4,653,998 | 3/1987 | Sohma et al. | 431/79 |
| 4,737,844 | 4/1988 | Kohola et al. | 358/100 |
| 4,756,684 | 7/1988 | Nishikawa et al. | 431/79 |
| 4,895,081 | 1/1990 | Homer et al. | 110/186 |
| 4,907,281 | 3/1990 | Hirvonen et al. | 382/1 |
| 4,934,926 | 6/1990 | Yamazaki et al. | 431/75 |
| 4,953,477 | 9/1990 | Martin | 110/190 |
| 4,973,159 | 11/1990 | Sohma et al. | 356/328 |
| 5,010,827 | 4/1991 | Kychakoff et al. | 110/185 |
| 5,041,916 | 8/1991 | Yoshida et al. | 358/433 |
| 5,043,913 | 8/1991 | Furutani | 364/513 |
| 5,148,667 | 9/1992 | Morey . | |

OTHER PUBLICATIONS

"Individual Burner Fuel/Air Ratio Control Optical Adaptive Feedback Control System", Jan., 1982, M.I.T. Energy Laboratory Report No. MIT-EL-8-2-001.

Zabielski M. F., L. J. L. Daigle, "An Infrared Based Fuel/Air Control for Boilers Fired with Natural Gas", pp. 199-203, 1986 Symposium on Industrial Combustion Technologies, Apr. 20-30, 1986.

Gutmark, E., Parr, T. P., Hanson-Parr, D. M., and Schadow, K. C., "Use of Chemiluminescence and Neural Networks in Active Combustion Control", pp. 1101-1106, Twenty-Third Symposium (International) on Combustion/ The Combustion Institute, 1990.

Chau, P. K., Hampartsoumian, E., and Williams A., "Fibre-Optic Spectral Flame Analysis for the Control of Combustion Processes", 423, Int. J. of Optoelectronics 3, 1988, pp. 423-431.

*Primary Examiner*—Carroll B. Dority
*Attorney, Agent, or Firm*—Laurence Coit

[57] ABSTRACT

Disclosed is an integrated imaging sensor/neural network controller for combustion control systems. The controller uses electronic imaging sensing of chemiluminescence from a combustion system, combined with neural network image processing, to sensitively identify and control a complex combustion system. The imaging system used is not adversely affected by the normal emissions variations caused by changes in burner load and flame position. By incorporating neural networks to learn emission patterns associated with combustor performance, control using image technology is fast enough to be used in a real time, closed loop control system. This advance in sensing and control strategy allows use of the spatial distribution of important parameters in the combustion system in identifying the overall operation condition of a given combustor and in formulating a control response accorded to a pre-determined control model.

25 Claims, 12 Drawing Sheets

DYNAMIC STABILITY WITH FIVE OUTPUT STATES

NO DAMPING

INTEGRATED IMAGING SENSOR/NEURAL NETWORK CONTROLLER FOR COMBUSTION SYSTEMS

BACKGROUND OF INVENTION

1. Field of Invention

This invention relates to combustion control systems and more particularly to a new combustion control system which uses chemiluminescence of the flame to control the flow of fuel and air to the primary combustion reaction zone.

2. Related Art

The efficiency of many heat transfer processes is directly related to the efficiency of a combustion reaction. Although many factors such as fuel atomization, reaction zone temperature and content of volatile material in the fuel influence combustion efficiency, one of the most important factors is fuel air ratio. For a given quantity of fuel having a fixed content, a theoretical amount of oxygen must be available for complete combustion of the fuel. Combustion under these conditions is termed stoichiometric combustion. If insufficient oxygen is provided, not all of the fuel will be combusted resulting in decreased combustion efficiency. If excess oxygen is provided, some of the heat generated by combustion is used to heat the excess oxygen again resulting in decreased efficiency. In addition to the thermodynamic efficiency of the process, another important consideration is the reduction in pollutants emitted from the combustion process. By accomplishing complete combustion of fuels, pollutant emissions such as carbon monoxide and soot are minimized. The combined combustion aspects of thermodynamic efficiency and complete combustion to reduce pollution emissions can be termed flame quality.

In modern utility fossil fired boilers, complicated analog or digital control systems are used to regulate fuel air ratio to obtain optimal flame quality. Generally, these systems measure the flow of fuel and combustion air to the furnace and adjust one or the other to obtain the correct fuel air ratio. The measurement of fuel flow has a number of difficult problems. If the fuel is liquid, such as No. 6 fuel oil, a venturi or turbine flow meter is the normal method of measurement. To obtain accurate measurement with these instruments, it is usually necessary to mount them in a pipeline having a sufficient length of straight pipe upstream and downstream of the instrument to avoid inaccuracies caused by disparate crosssectional velocity profile within the pipe. In addition, since the venturi or turbine flow meter is basically a volume measuring device, density corrections such as temperature compensation must be added to accurately convert the volume measurement to a mass measurement. If the fuel is solid, such as coal, the fuel flow measurement becomes even more difficult. In coal fired utility boilers, fuel flow measurement is generally accomplished by weigh scale feeders used to transport coal to the pulverizers (mills). These feeders cannot discriminate between coal and scrap material such as dirt or clay which is always present to some degree in the coal fed to the pulverizers. In addition, variations in moisture content of the coal significantly impact the measurement. Even if complicated compensation systems are added to the control system to correct for the variables described above, the content of major combustion reactants, carbon and hydrogen, in a given quantity of fuel (liquid or solid) can vary significantly.

Presently, there is no satisfactory method of real-time measurement of these parameters. Accurate measurement of combustion air flow has difficulties similar to those associated with fuel flow. Combustion air flow in a utility boiler is generally measured in one or two large supply ducts. The measurement device is influenced by turns and bends in the duct upstream and downstream of the device. To eliminate this influence, designers attempt to have sufficient straight runs of ducting before and after the device. The length of the necessary straight runs is related to the crosssectional area of the duct and is rarely available for the designer in a typical, compact boiler plant layout. Air flow measurement accuracy is also degraded by leaks in seals and ductwork downstream of the measurement point. Also, the need to convert volume measurement to mass measurement described above is applicable to the air flow measurement.

To account for some of the problems outlined above, combustion control designers have utilized post combustion flue gas analysis measurement to correct or trim the fuel air ratio. Usually these systems measure the oxygen, carbon dioxide or carbon monoxide content of the flue gas. If the flue gas contains excessive oxygen, too much combustion air is being delivered to the combustion zone resulting in decreased efficiency. If the flue gas contains excess carbon monoxide, insufficient combustion air is being delivered thereby preventing complete combustion to carbon dioxide and again limiting the efficiency of the combustion process. If sufficient information is available on the carbon content of the fuel being burned, carbon dioxide measurement of the flue gas can also be used to trim fuel air ratio to the optimum point. Flue gas analysis devices are complicated and require substantial maintenance to achieve an acceptable reliability for a utility boiler combustion control system. The flue gas analysis devices are generally located in ducts downstream of the furnace and therefore analyze the combined gases from all of the burners in the boiler. Thus, if one burner of a multiple burner installation is operating with an inefficient fuel air ratio, the device may not detect the inefficient operation and certainly could not determine which burner was causing the inefficiency. In addition, most utility boilers utilize induced draft fans to withdraw combustion gases from the furnace. The induced draft fans cause the interior of the furnace to operate at a slightly negative pressure compared to surrounding atmospheric pressure. Thus any leaks in the furnace casing cause excess air to enter the flue gas path downstream of the combustion zone leading to artificially high oxygen content readings.

One solution to the above described problems is to measure the combustion efficiency or flame quality right at the flame front. J. M. Beer et al in their report (Beer, J. M., Jacques, M. T., and Teare, J. D., "Individual Burner Air-Fuel Ratio Control: Optical Adaptive Feedback Control System," M.I.T. Energy Laboratory Report No. MIT-EL-82-001, 1982) discuss the use of spectrometric measurements of the emissions of ultraviolet and infrared radiation from the flame front as an indicator of flame quality and combustion efficiency. These investigations found that using a single detector and monochromator directed at a single region of the flame and turned to the spectral frequency associated with radiation emitted from the OH radical provided repeatable and accurate information on combustion efficiency within a narrow range of burner load. Significant difficulties were encountered when this approach was used over a wide burner load range. The monochromator was positioned and focused to collect emission data from a single small region near the burner end. The detector used with the monochromator produces an analog output proportional to total emission in the frequency range of interest within the monochromator's field of view. Consequently, as burner load changed, the flame geometry and position, as influenced by aerodynamic flow variations, significantly impacted the measurement of OH emissions. As burner load increased, the higher flow of fuel and air shifts the location of OH radical production within the flame envelop and therefore makes the measurement system extremely sensitive to burner load. In addition, since the monochromator in effect measured the average emission from the focal plane, it could not recognize variations of emissions from different parts of the focal plane.

In a similar approach using chemiluminescence to monitor flame quality, E. Gutmark et al (Gutmark, E., Parr, T. P., Hanson-Parr, D. M., and Schadow, K. C., "Use of Chemiluminescence and Neural Networks in Active Combustion Control," *Proc. of 23rd Symposium (Int.) on Combustion* (Pittsburgh: The Combustion Institute), 1101, 1990) showed that measurement of CH radicals were an effective measure of flame quality. To improve accuracy of the measurement, the system included a soot measurement instrument and used six variations of the CH radical and soot readings including, average CH, average soot, root mean square CH, peak CH, peak soot and CH/soot relative phase. A neural network was developed to emulate the operation of the laboratory type burner used to test the system. The neural network emulator used inputs from the fuel delivery equipment comprising fuel flow fluctuation frequency and amplitude which were the controlled variables in the experiments. Although the neural network emulator was successful at modeling the CH output from the flame, it did not account for the previously described problems associated with varying burner load and the resulting changes in flame geometry and position.

The problems associated with flame geometry and positioning were recognized and addressed in U.S. Pat. No. 4,555,800 issued to Nishikawa et al on Nov. 26, 1985. This patent discloses an imaging system used to categorize flame patterns by their geometry. The system captures an image of the flame and compares its geometry to a set of image standards which have been developed and stored in a computer beforehand. The image standards have known carbon monoxide (CO) and nitrogen oxide (NOx) content for diagnosing the state of the flame in regard to these parameters. The patent does not disclose how the image standards are developed, but it is apparent that the accuracy of the system is dependent on the empirically derived relationship between the flame geometry and CO and NOx content. The flame images record the entire visible spectrum emitted by the flame, including soot, hot particles or ash, and visible gas-phase emitting species. The system, therefore, is not sensitive to gas chemistry alone and may easily be confounded by changes in soot or particulate loading. In addition, since flame shape is highly dependent on the geometry of the burner equipment, windbox and furnace, image standards would have to be developed for each combustor installation to achieve accurate results.

Consequently, there is still a need for an accurate and effective measurement of combustion efficiency and flame quality which can be made right at the burner combustion flame front and are specific to critical reaction species.

SUMMARY OF INVENTION WITH OBJECTS

It is one object of the present invention to provide an effective measure at a burner flame front of combustion efficiency and flame quality.

It is another object of the present invention to provide a reliable measure of combustion efficiency which can be used in a closed loop control system for fuel air ratio control.

It is another object of the present invention to provide a measure of flame quality which is independent of flame geometry and position in relation to the sensor.

It is another object of the present invention to provide an image based measurement system for flame quality.

It is another object of the present invention to provide a neural network for processing image information fast enough to be used in a closed loop control system for combustion control.

These and other objects are accomplished with an integrated imaging sensor/neural network controller for combustion control systems. The controller uses electronic imaging sensing of chemiluminescence from a combustion system, combined with neural network image processing, to sensitively identify and control a complex combustion system. The imaging system used is not adversely affected by the normal emissions variations caused by changes in burner load and flame position. By incorporating neural networks to learn emission patterns associated with combustor performance, control using image technology is fast enough to be used in a real time, closed loop control system. This advance in sensing and control strategy allows use of the spatial distribution of important parameters in the combustion system in identifying the overall operating condition of a given combustor and in formulating a control response accorded to a pre-determined control model.

DESCRIPTION OF THE PREFERRED EMBODIMENT

Figure 1:
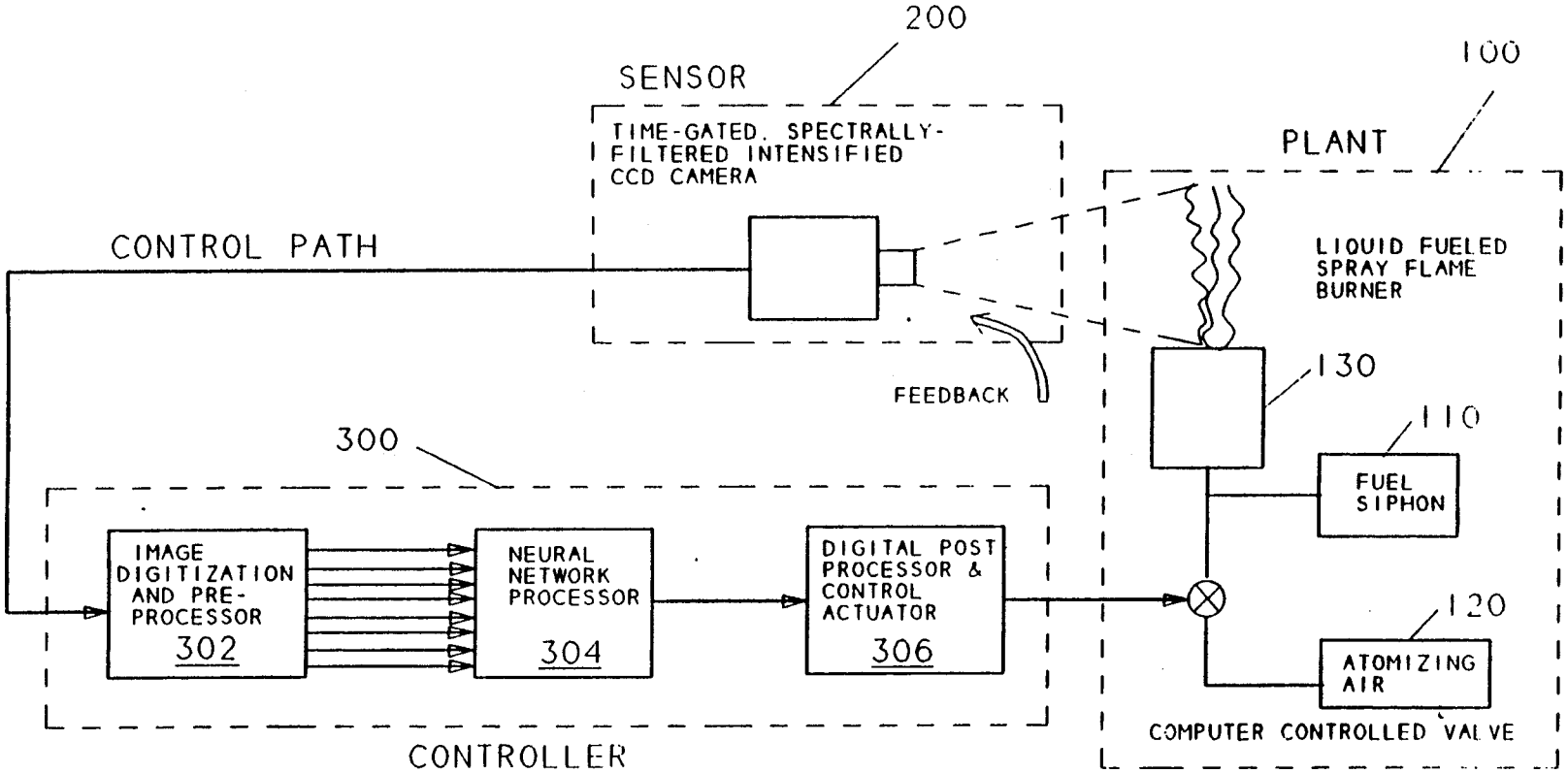
FIG. 1 is a schematic diagram of the controller system showing the connection of major components and the interface with the combustion burner.
Figure 1A:
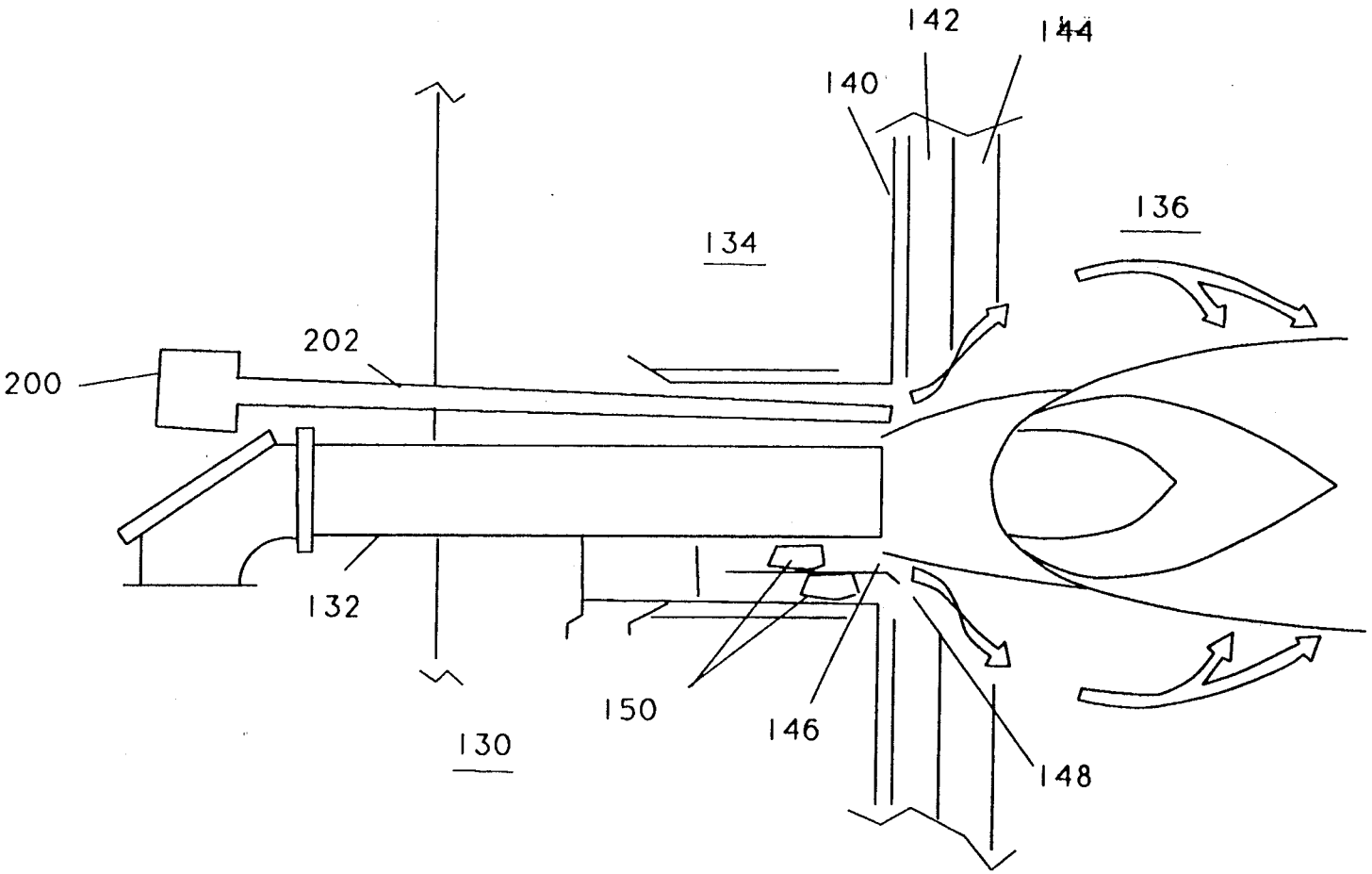
FIG. 1A is an elevation view of a potential burner installation on a utility boiler showing the location of the sensor in relation to the burner.

A schematic diagram of the control system is shown in FIG. 1. The control system consists of three basic components: the plant (i.e., the system to be controlled) 100, the sensor 200, and the controller 300. The plant 100 may be any type of combustion facility burning fossil fuel including oil, natural gas, coal, lignite, bagasse, waste incineration, black liquor or any combination thereof. In its simplest form, the combustion facility 100 consists of fuel delivery equipment 110, air delivery equipment 120 and a burner 130 for mixing the air and fuel prior to combustion. The various forms of fuel and air delivery equipment used in combustion facilities are commonly known to those skilled in the art and will not be further described. However, the burner assembly 130 is important to the working of the invention and therefore will be described in more detail. FIG. 1A shows a typical burner used in a utility boiler. The burner 130 consists of a fuel delivery nozzle 132 connected to the fuel delivery equipment (not shown) and extending through a windbox 134 into the furnace 136. The furnace wall 138 is typically made from flat plate 140, insulation material 142 and tangentially mounted tubes 144 carrying the working fluid which is typically water. An aperture 146 through the furnace wall is located where the fuel delivery nozzle 132 extends into the furnace 136. The aperture 146 is sized considerably larger than the diameter of the fuel delivery nozzle 132 thus forming an annular space 148 for combustion air to enter the furnace 136. Combustion air is supplied to the windbox 134 under pressure by the air delivery equipment (not shown). Around the fuel delivery nozzle 132 and generally coincident with the circumference of aperture 146 are moveable vanes 150. These vanes 150 can be positioned between a fully opened position and a fully closed position to control the volume of air flow to the burner. As air flows from the windbox 134 through the annular space 148, it mixes in a turbulent fashion with the fuel being sprayed by the fuel delivery nozzle 132. In operation, fuel and air are delivered to the burner in the correct proportions and an ignition source is used at the end of the fuel delivery nozzle to promote ignition. This operation results in a self sustaining flame emanating from the nozzle into the furnace. Although one particular burner arrangement is described above for illustration purposes, it is readily understood by those skilled in the art, that the present invention is equally applicable to the myriad of burner arrangements commercially available.

Mounted near the burner 130 is flame sensor 200. The flame sensor is mounted on a sight tube 202 which extends through the windbox 134 into the furnace 136. The sensor and sight tube are aligned so that radiation from the flame is directed to the sensor. The sensor 200 is a gated, intensified charged coupled device (CCD) array camera, consisting of ultra-violet (UV)-visible image intensifier coupled to a 512×240 element CCD array. A suitable CCD array photodetector is the Model NXA1061 manufactured by Phillips. Also suitable is an infra-red imaging detector using either PtSi, InSb, or HgCdTe detection elements. Cameras based on these detectors are commercially available from numerous manufacturers. In addition to providing near single photon sensitivity throughout the visible and UV, the intensifier can be gated to freeze the temporal fluctuations of the emitted light from the flame. The images so recorded represent the instantaneous distribution of emitting species in the image volume. Several potential emitters are present in the flame. Emission from the CH radical (around 430 nm) is known to peak in the reaction zone of pre-mixed hydrocarbon flames and has been used as an indicator of the volumetric energy release rate in unstable combustion systems. OH emission (between 280 nm and 330 nm), originating from chemiluminescence, also peaks in the reaction zone and is an indicator of regions of vigorous combustion. Either CH or OH emission are satisfactory for use with the invention. Using UG-5 filter glass, which transmits wavelengths between about 250 and 400 nm, the sensor records images of the combustion zones in the primary combustion portion of the flame by imaging the OH chemiluminescence emission. Using an infrared camera with bandpass interference filters, other emitting species could also be imaged. For example, CO could be imaged between 2.3 μm and 2.4 μm, $CO_2$ between 4.2 μm and 4.3 μm, and $H_2O$ near 1.8 μm. A combination of UV imaging for OH and infrared imaging for one or more of the above species may be desirable for more sensitive monitoring and control. Encoded within the spatial distribution of these images are the overall level of turbulence in the flame, the penetration of the fuel spray, and the degree of atomization of the fuel jet. The images from the CCD camera provide sufficient combustion information to reliably control the fuel air ratio and achieve optimal flame quality. The camera itself is capable of sampling the combustion system at rates up to 60 Hz. Each sample is time-gated to about 30 μs, providing a temporally "frozen" snapshot of the turbulent flame. The total bandwidth of the control system, therefore, is limited to 60 Hz, although the time-resolved images provide a spatial record of the temporal fluctuations across the flame at much higher bandwidths. A principal distinguishing characteristic of the flame quality is the spatial scale sizes associated with the flow turbulence. These scales are frozen in the image but represent the effect of temporal fluctuations in the range of several Khz. This high frequency information is available in the image because of the high-speed gating used. The typical gates of 30 μs used here permit temporal resolution of fluctuations within the image up to approximately 33 kHz. Higher frequencies could be achieved using a faster intensifier gate, although the present frequency range is sufficient for boiler applications.

The controller 300 consists of three subsystems: 1) image acquisition and pre-processor 302, 2) neural network processor 304, and 3) digital post-processor and control actuator 306. All of these software systems reside on a common PC platform and are incorporated into a single environment and user interface.

The first subsystem of the controller 300 consists of the image pre-processor 302. The image pre-processor uses a fast, commercially available frame-grabber technology to digitize the analog data from the CCD and perform simple pre-processing before presenting the image to the neural network. A suitable pre-processor is the Data Translation Model DT-2853 frame-grabber.

Following digitization, the controller design performs three simple image processing functions. First, the centroid of the flame image is defined and a region-of-interest is calculated about this centroid. Thus, the data presented to the neural network is insensitive to the position of the flame image within the camera field of view. From a practical point of view, this means that the controller does not depend on maintaining an exact geometrical relationship between the camera and the flame. In the second step, the intensity data from the region-of-interest is corrected for variations in the background noise level of the camera and is rescaled to fill the entire signal dynamic range of the detector. The resultant image is independent of the absolute signal level in the data and is thus insensitive to calibration and offset drifts of the sensor. Finally, the region-of-interest is reduced into a 32×32 pixel image. This reduces the number of neural network input nodes required to 1024 and helps to filter out the highest spatial frequencies of the data. The primary motivation for this step is simply to reduce the size and training time of the neural network.

It is important to note that the data presented to the neural network is the relative OH emission within the flame, independent of total flame luminosity, flame position, detector gain, etc. This is important for a practical system in that it reduces the sensitivity of the controller to the exact position of the camera relative to the flame, possible obscuration of the viewing port due to soot or ash accumulation, or long-term variations in the system sensitivity due to changing environmental conditions.

Figure 2:
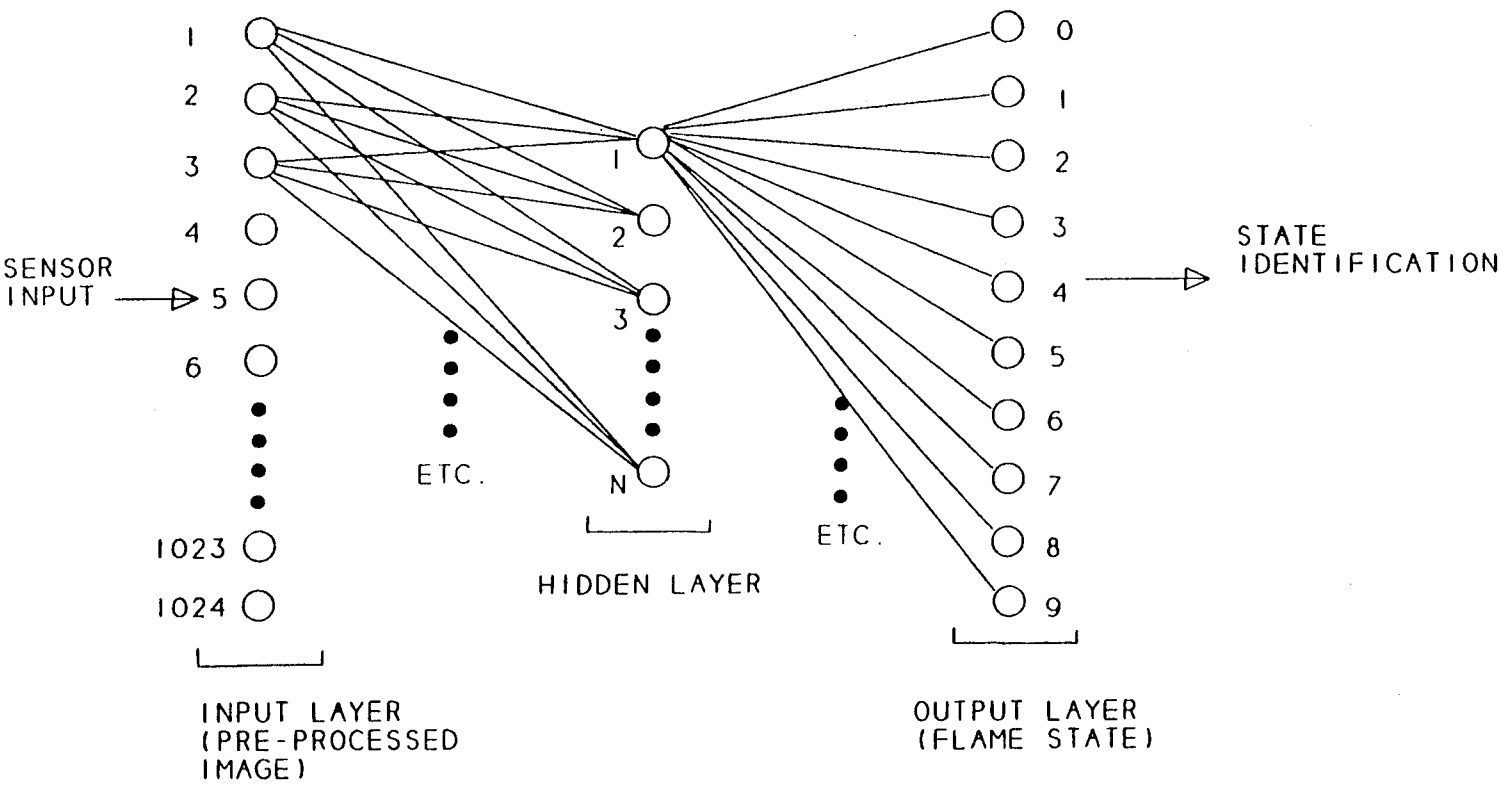
FIG. 2 is a logic diagram depicting the feed-forward neural network used to analyze the flame image data from the sensor.

The second subsystem is the neural network processor 304. FIG. 2 is a logic diagram of a generic type of neural network design used with the current invention. The network is emulated in a software package (NeuralWorks Professional II/Plus from NeuralWare Inc.) on a data acquisition PC platform. The 32×32 image is presented to the 1024 nodes of the input layer. The 32×32 image could be presented with any arbitrary order of the pixel data, so long as the presentation is consistent. In this fully-connected, feed-forward design, each input node is connected to each of some number of nodes in the so-called hidden layer. One or more hidden layers may be used. Each of the nodes in the hidden layer is, in turn, connected to each node of the output layer. The output layer is identified with the flame quality.

The network is trained with a large (~5000 image) set of images recorded at known states. This training is done on-line at the particular installation. Once trained, however, the neural network can be operated as an adaptive controller, permitting periodic updates or retraining as changing combustor conditions demand. This on-line retraining capability is a salutary attribute unique to the neural network-based system. Initially, the weighting of the connections between the input and hidden layers, and between the hidden and output layers are randomly set. A training image is presented to the input layer and allowed to propagate to the output layer, where each output node obtains a value between 0 and 1. An output value of 1 at a node is associated with identification of a unique state. With the initial random weighting of the nodal connections, the network does not initially, correctly identify the flame state. For training, the network is presented the correct state vector (all output states are zero except the correct state at which the training image was acquired). The difference between the desired output and the actual output at each node is the error and is back-propagated through the hidden layer. Algorithms in the emulation software adjust the weightings of each connection in order to minimize the error signal at the output nodes. The process is repeated for all of the training images until the network reliably identifies the flame state.

The principal design variable in this type of network is the number of nodes in the hidden layer and the overall number of hidden layers. An upper limit of hidden layer size would be the same number of nodes as the input layer. It is found that hidden layers of this size memorize the training sets with a high accuracy, but are unable to generalize in order to correctly identify new images. Conversely, a small number of nodes in the hidden layer forces the trained network to generalize extensively, but may not capture the complexity of the data sets sufficiently to allow reliable identification of new images.

The third subsystem of the controller performs digital post-processing of the neural network output. Ideally, the network would return a single value of 1 on the identified state and values of zero on the remaining states. In practice, however, one state will have a value which is higher than any other output state, but less than one. The post-processing portion of the controller interrogates these outputs and formulates the control decision, namely increase, decrease or hold steady the fuel air ratio. The most fundamental step of the post-processor is to identify the state with the highest value at the output node. Since the network may not confidently identify a state in every given image, some measure of confidence is sought in the post-processing. Since the flame state changes slowly with respect to the sample time, constructing a histogram of successive samples provides a convenient means for calculating the probability that a state was correctly identified. In the histogram construction, the state with the largest number of identifications is considered the identified state.

Lastly, the post-processing step calculates the positioning signal to be sent to either the fuel control valve or the air control mechanism to adjust fuel air ratio. In addition, the post-processor can calculate positioning signals to control other variables which impact the quality of flame including atomizing air pressure, fuel oil temperature, fuel oil viscosity or combustion air temperature. The present invention uses a straight-forward proportional controller algorithm. In this type of controller, the voltage ($V_c$) applied to the plant is proportional to the error between the desired state ($S_d$) and the identified, or actual, state ($S_a$) according the equation $$V_c = G(S_d - S_a). \tag{2-1}$$

The constant G is the gain of the controller and is adjustable. The larger the gain, the more quickly the controller responds but too high of gain may lead to control instability. Although a simple proportional control system can be used, it is readily understood that more complex proportional plus integral or derivative scheme can be used with their attendant improvement in control response.

The continuous input data rate from the imaging sensor is 5 Mhz. Each digitized image contains nearly 250,000 discrete samples which are processed in parallel by the neural network. The neural network in the control system is necessary to process this large amount of data in parallel, thereby permitting complex spatial information to be interpreted and acted upon in real-time. When operating in closed-loop mode, the controller continuously "views" the world through the imaging sensor, "interprets" what it sees, and "acts" upon this interpretation according to the pre-determined control strategy.

Although the above system description addresses a combustion control system, it is readily understood that by routing the output from the neural network processor 304 to a standard display device (not shown), the system becomes an effective combustion monitor. Standard display devices known in the art such as CRT's or analog dial indicators are suitable for this function.

Tests of the new integrated imaging sensor/neural network controller were conducted by the inventors. The flame for the combustion demonstration test was a liquid-fueled spray flame. The spray flame was fueled by an air atomizing siphon nozzle, whose operational state was determined by a single-variable input: the atomizing air flow rate. A computer-controlled value in the atomizing air delivery system provided the control actuator for the plant.

The spray flame burned steadily for a wide range of atomizing air flow rates. Generally, as the atomizing air flow rate increased, the fuel spray was more finely atomized and the turbulence level of the resulting flame increased. As the flow rate decreased from the nominal operating point, the spray atomization became increasingly poor and a minimum flow rate condition existed below which the spray was too poorly atomized to burn. This state was termed "sputter out" and defined as the lowest operational state of the system. Conversely, as the atomizing air flow rate increased above the nominal operational state, a maximum flow rate was achieved beyond which the momentum of the primary fuel spray was too high to permit stable burning and the flame reached a "blow off" state. Thus, the operational states of the flame existed between sputter out and blow off. The intermediate flame states were arbitrarily qualified as ten discrete operational conditions of the spray flame between sputter out and blow off.

These states were a discrete mapping of the atomizing air flow rate. In particular, the range of flow rates between sputter out and blow off for the current setup were 6.2 to 12.5 liters per minute (lpm). Flame state zero was identified with no flame. Flame states 1 through 9 corresponded to equal increments of the operating range, i.e., 6.2 to 6.8 lpm was state 1, 6.9 to 7.6 lpm was state 2, etc. This ten-element output state vector was a purely arbitrary choice selected because it represented a reasonable subdivision of the continuous flame state. Since the initial discretization of the output state into 10 bins was arbitrary, we explored bin combinations in static stability tests. In this step, the outputs from two or three states were combined into a single output state, effectively reducing the resolution of the output state of the flame from 10 bins to 5 or 3.

In the closed-loop tests, the full 10 output states were used along with calculation of a running average. This is analogous to simple damping in a mechanical controller or time filtering in an electronic controller. Instead of conducting a histogram analysis of the network output from several samples, a running mean of identified states was calculated using three or four of the previous identifications. Thus, instead of an integer state identification, a real (fractional) number was calculated which was found to improve the performance of the dynamic and closed-loop controller without the sacrifice of response time required by the histogram analysis.

Since both the total fuel delivery and the atomization efficiency were controlled by the atomizing air flow rate, the operational states were identified with the total energy release rate. Thus, higher atomizing air flow rates resulted in a higher burner total energy release rate. The system sensed flame emission patterns in order to identify and control the total energy release rate of the burner. In order to characterize the response of this novel controller concept, a simple model control problem for the burner was developed. In this model, the integrated imaging system/neural network would function as a flame state controller with the sensor being the imaging system and the actuator being the computer-controlled valve. Since the flame state is directly related to the total energy release rate of the burner, the model problem is analogous to a load controller for a utility boiler. A series of tests were undertaken to characterize the controller's static and dynamic response in open-loop. These open-loop tests were used to optimize the network design and the post-processing algorithms prior to closed-loop testing. A final series of closed-loop tests were completed which characterized overall system's response to step, ramp, and cyclical inputs.

The most extensive and stringent tests of the controller were undertaken in static stability. These tests assess the accuracy of the neural network as a flame state identifier and provided the information used to optimize the network architecture during training. They incorporate no post-processing of the neural network output and, as will be demonstrated in the dynamic and closed-loop testing, result in a more critical evaluation of the control system than would be gleaned from application testing alone.

Figure 3:
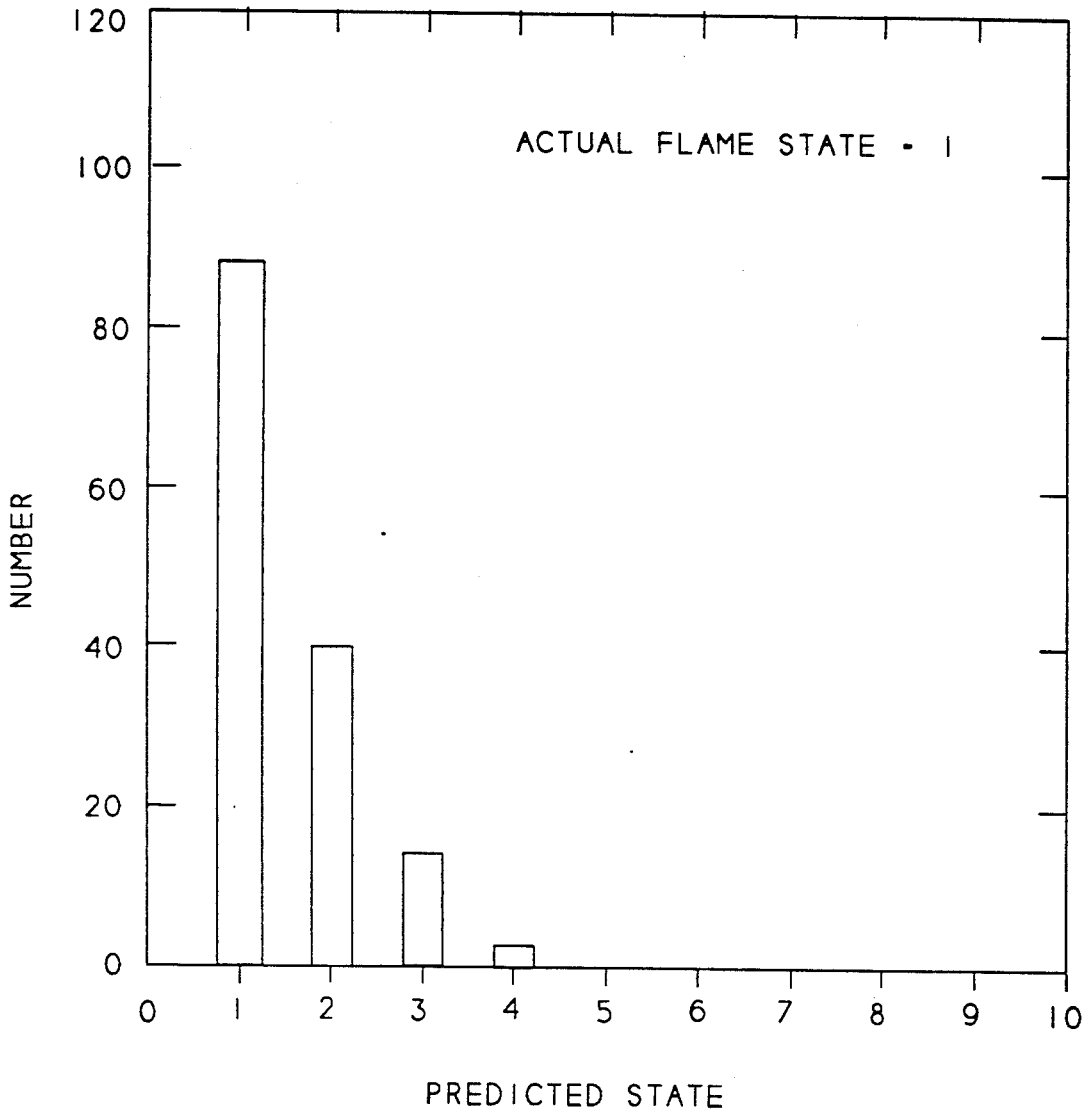
FIG. 3 is a histogram analysis of the neural network output for flame state 1.
Figure 4:
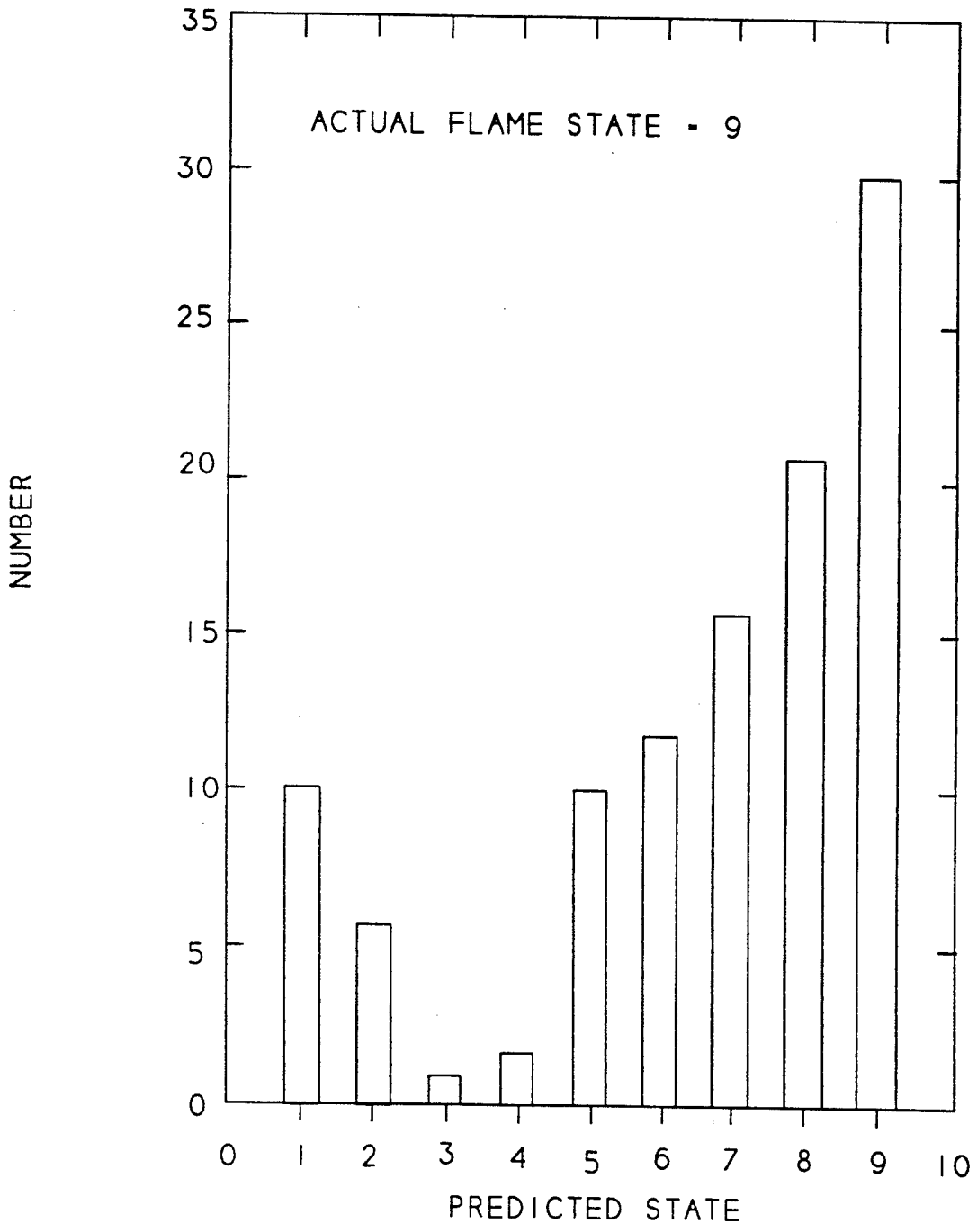
FIG. 4 is a histogram analysis of the neural network output for flame state 9.

Example histogram analyses of a single-hidden layer network are shown in FIG. 3 and FIG. 4. In these experiments, the network examined over 100 images of the OH flame emission while the flame state was held at state 1 (FIG. 3) and state 9 (FIG. 4). An ideal network, of course, would correctly identify the state in every sample.

In FIG. 3, however, the histogram analysis shows a finite distribution of erroneous identifications, but is strongly peaked at the correct value. Some misidentification in this highly turbulent system is to be expected. Since the histogram is strongly grouped about the correct result, averaging of the state identifications over a few samples was sufficient to determine the actual state.

At higher atomizing air flow rates, we have observed that the histogram of the output states tends to broaden considerably. FIG. 4 is the analysis following presentation of 108 OH emission images from state 9 to the network. The histogram still peaks at the correct value, although the peak is must less pronounced than in FIG. 3. There is a surprising secondary peak at state 1. If a histogram analysis was used to determine the most probable state, a rather large number of samples would have to be accumulated. By performing a numerical average of the state identifications, however, the nearby identifications at values of 8 and 7 contribute much more strongly to the average than due to the misidentifications at the bottom of the scale. Hence, these tests showed that numerical averaging was superior to histogram analysis for this network and model control problem.

Figure 5:
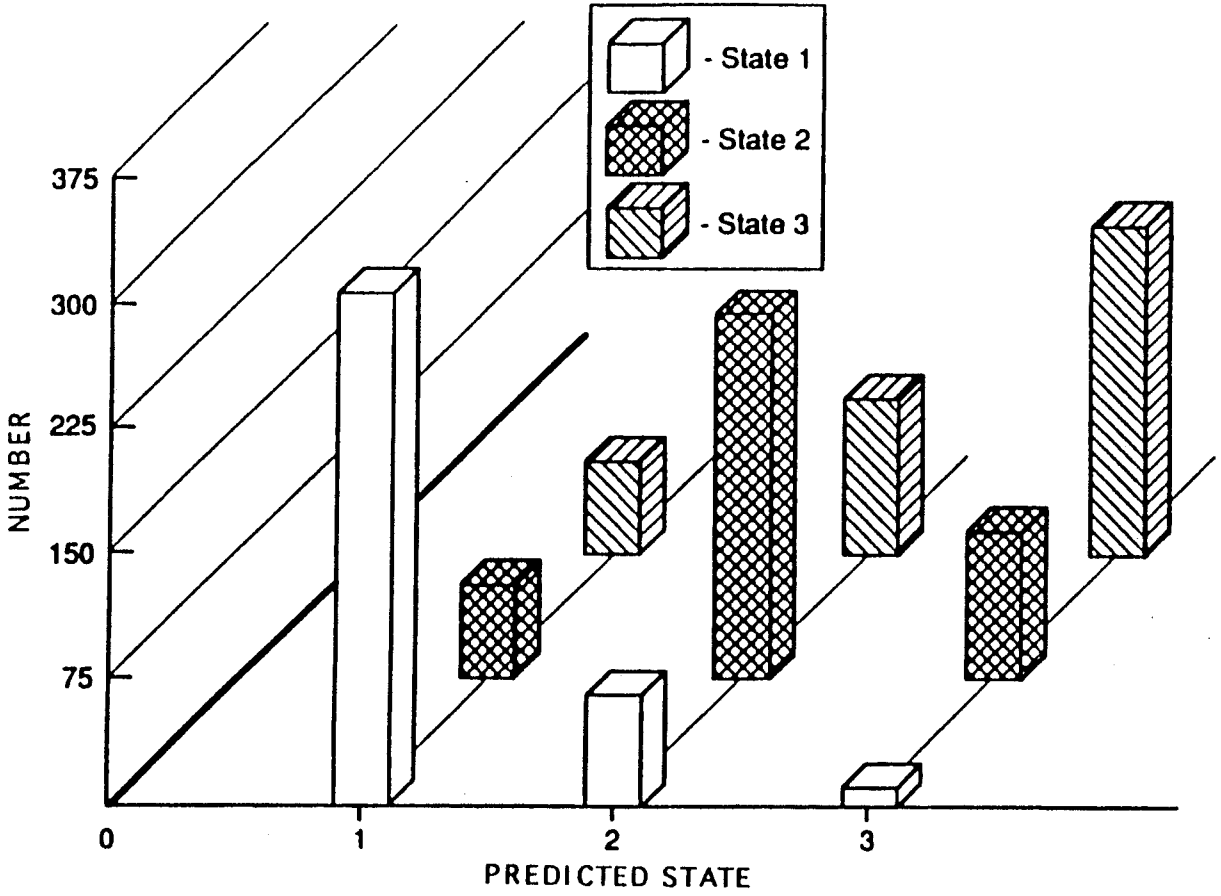
FIG. 5 is a histogram analysis of reduced neural network output for three output states.

There are several possible explanations for the spread in the identified state distributions for higher actual states. One explanation is systemic. Recall that the initial dissection of the output state of the flame into 10 equal flow rate increments of the atomizing air flow was completely arbitrary. It is reasonable that 10 distinguishable states of the flame simply do not exist. If the output states are grouped together by 3, so that states 1 to 3 now correspond to state 1, states 4 to 6 now correspond to state 2, and states 7 to 9 correspond to state 3, the performance in terms of absolute accuracy of the network improves markedly. FIG. 5 is a histogram showing the outputs for the reduced network when presented with the same training set as FIG. 3 and FIG. 4. Example distributions for each of the three output states are simultaneously displayed, showing the narrow distributions about each correct value. Indeed, the reduced network is correct more than 67% of the time without any averaging of the output states whatsoever. There is still some broadening of the histograms toward higher flame states.

Figure 6:
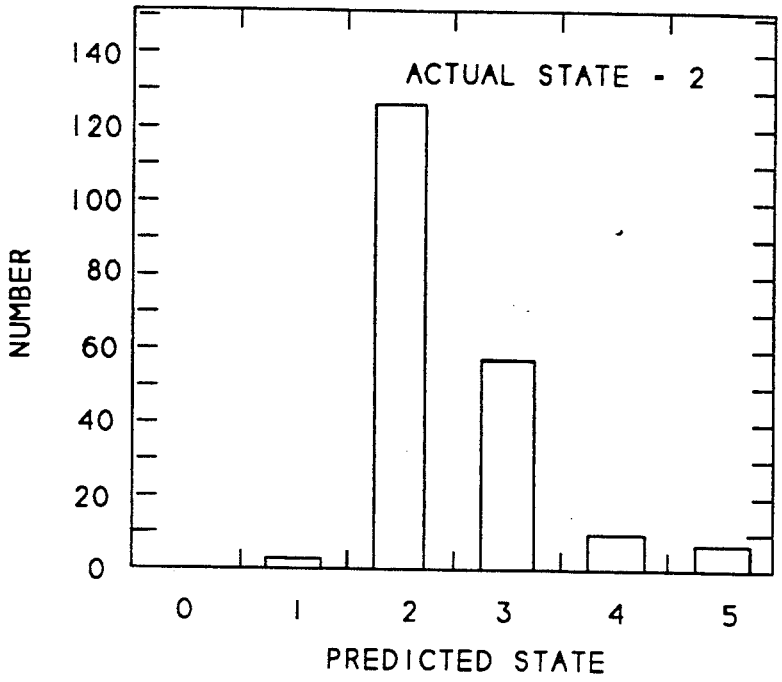
FIG. 6 is a histogram analysis of reduced neural network output for five output states.
Figure 7:
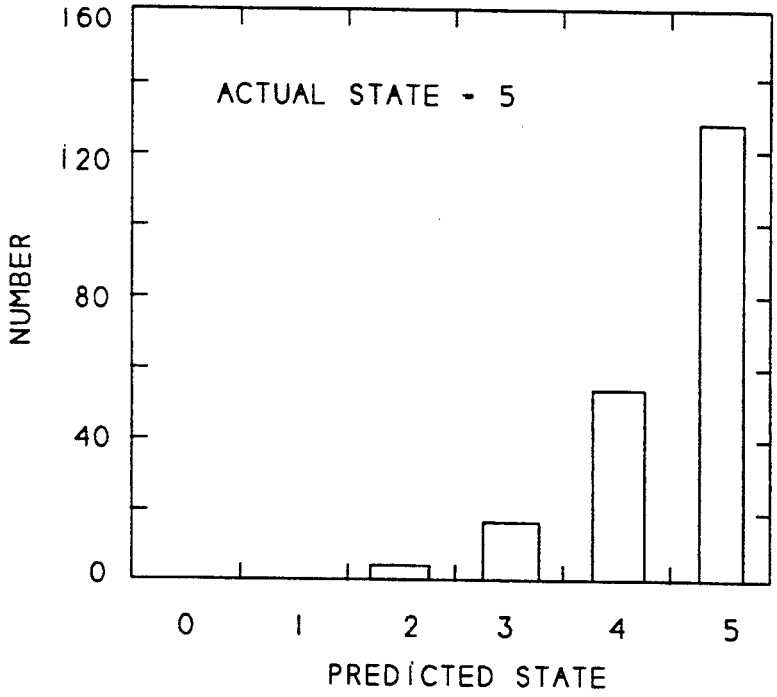
FIG. 7 is a histogram analysis of reduced neural network output for five output states.

A three-state discretization scheme is the minimum required for a controller: reduce, stay, or increase. Grouping the outputs into 5 states provides further control options. FIG. 6 and FIG. 7 show histogram analyses of the final two-hidden-layer network for five output states when presented with over two hundred images at state 2 (FIG. 6) and state 5 (FIG. 7). The performance of the network is substantially improved over the 10 state discretization scheme.

The tendency of the identified state probability distributions to broaden at higher flame states may also be related to our image pre-processing. As the flame state increases, the overall level of turbulence of the flow-field increases. As a result, the spatial complexity of the OH emission images also increases. One way to quantify this complexity is by considering the spatial frequency content of the image. This is completely analogous to the consideration of the temporal frequency content of a traditional single-point parameter as might be measured by a pressure or temperature transducer.

Calculation of the two-dimensional Fourier transform of the complete, 512×240 pixel image was not possible in the test setup because of computer platform memory limitations. However, the system was able to compute transforms from 128×128 images and compare them to the transform of the 32×32 image which was presented to the network. As suspected, the reduced resolution image, containing less than ⅛th of the spatial frequency content of the original image, removed much of the distinguishing spatial features of the images. Hence, it is reasonable to assume that the network is largely trained on the lowest frequencies of the images. In other words, the overall extent of the emission pattern, rather than the fine details of the flame patterns, may be determining the state which the network identifies.

Stability improvement can be realized by using a larger network with more input nodes. Alternatively, with a faster frame-grabber, it is possible to rapidly analyze the spatial frequency content of the incoming data and present the two-dimensional Fourier transform, or some subregion of the transform, directly to the network. In this way, the spatial content of the image will be remapped onto a two-dimensional spatial frequency map and reducing the resolution of the frequency image will not automatically average out high spatial frequency data.

Figure 8:
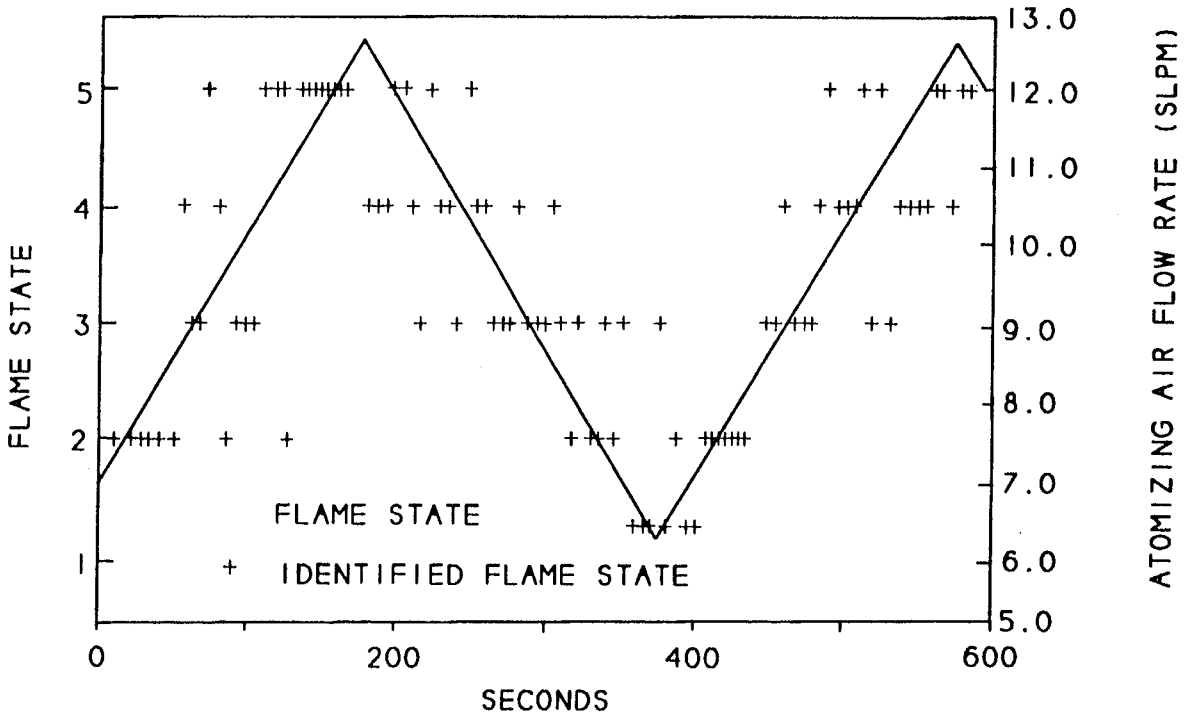
FIG. 8 is a graph of the system dynamic stability with five output states where no damping was used.

Following the static stability tests, the open-loop dynamic performance of the controller was investigated. Since the static stability tests indicated that reduction of the 10 output nodes of the neural network into five discrete states was optimum, dynamic testing was conducted in this configuration. FIG. 8 is a sample of the dynamic response of the open-loop system to a series of ramp inputs from the mid-point of state 1 (corresponding to state 2 of the original 10 output states) to the mid-point of state 5 (corresponding to state 9 of the original 10 output states). In this initial test, each sample identification was recorded as a data point in the figure.

Figure 9:
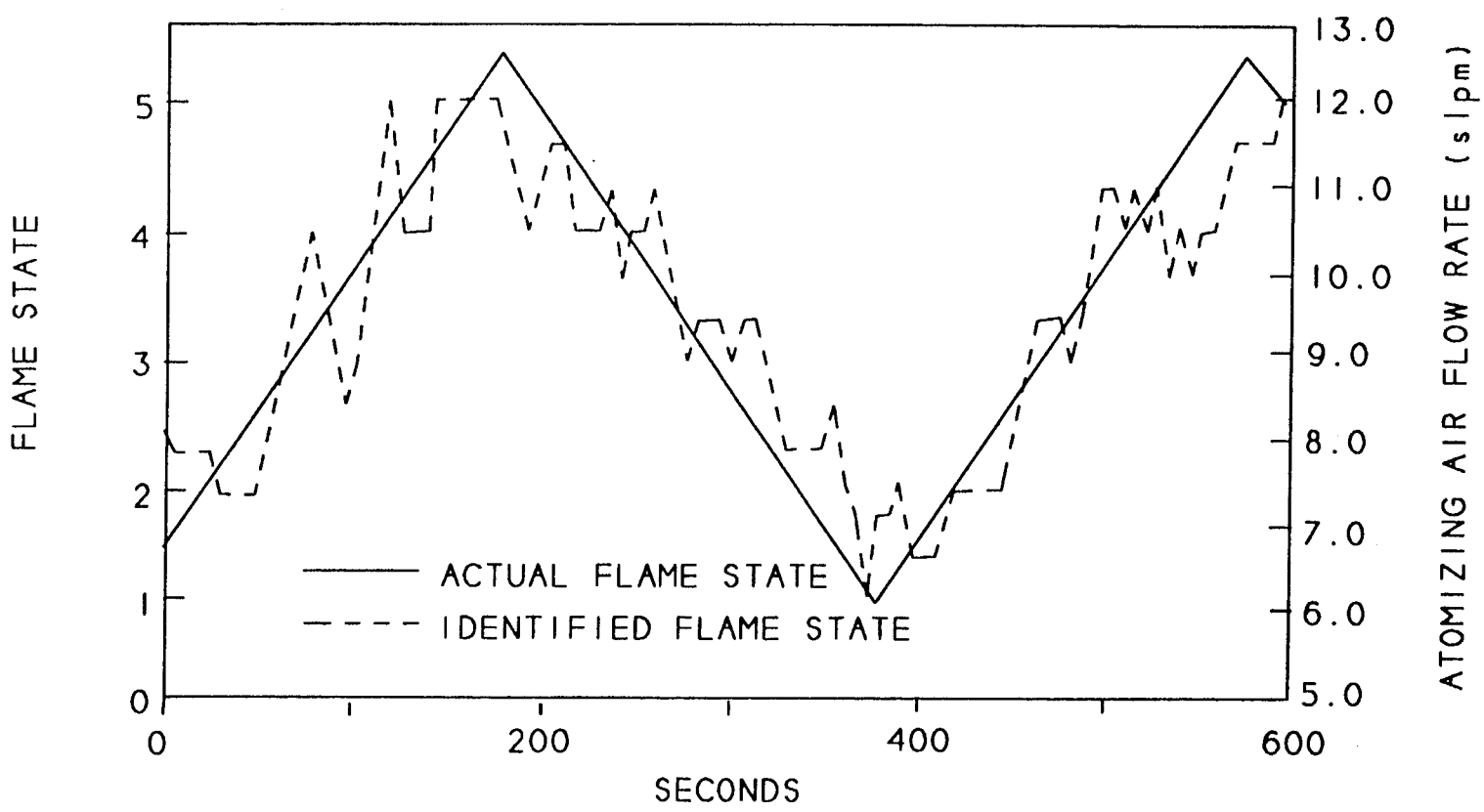
FIG. 9 is a graph of the system dynamic stability with five output states using three sample average.

The five-state discretization of each sample is obvious in the data, which otherwise follows the ramp function very well. The rather long time scale is a consequence of the long sample time (6 to 7s). Use of a faster hardware platform would result in a decrease of the sample time by about a factor of 100. Studies of this and other ramp responses suggested that a numerical average of the identified state would follow the imposed waveform more accurately than a histogram. FIG. 9 is an example of the ramp response through the same range of states when a three-sample running mean is imposed on the output. This averaging imposes an effective 18s time constant for our sample time, which would correspond to a time constant of less than 200 ms with improved image processing capability. Thus, the overall response time of the controller, defined as the time required for the controller to bring the system to within 5% of the desired value, would improve remarkably the reduction of the sample time.

The tracking of the imposed excursion is clearly improved by the running average and little or no measurable time lag (or phase shift) is discernable in the data. Further dynamic tests revealed that no reduction of the output nodes from the network was required if three or four samples were averaged in a running mean of the identified states. This was an encouraging result in that it suggested that the neural network controller was performing better in the actual testing than with the training set. Furthermore, with a modest time constant stable dynamic response was obtained.

Figure 10:
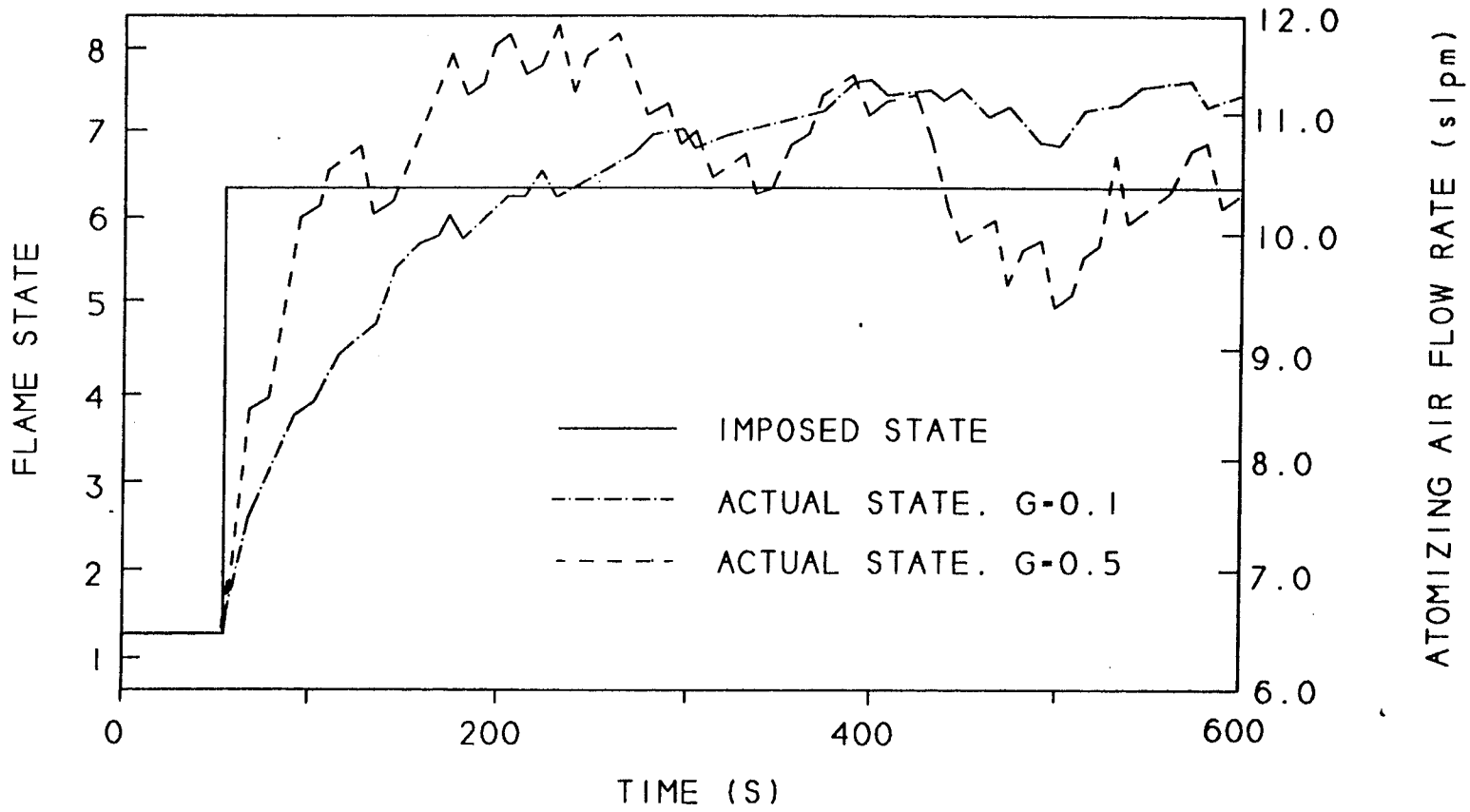
FIG. 10 is a graph of the system response in closed loop control to a step change input.

In the closed-loop tests, the controller was instructed to drive the flame through a preset series of excursions. The atomizing air flow rate, and thus the flame state, were recorded during the system's response, but the only feedback to the controller itself was the imaging system. An example of the proportional controller's response to a step input from state 2 to state 8 for two different gain values is shown in FIG. 10. For both of these gains, four successive samples were averaged for a dynamic time constant of about 25s.

Earlier tests of the computer-controlled valve, showed that its response time was on the order of 1s. Hence, the sample time is long compared to the response time of the valve, which can be considered to smoothly vary through series of quasi-steady states during the dynamic excursions reported herein.

The dashed line is the response for G=0.1, which slowly approaches the desired operating point in just under 300s and stably remains there. By analogy to a classical second order linear system, one would conclude that the system is behaving as if it were overdamped. The damping can be decreased by increasing the gain, as shown by the dotted line for G=0.5. For this case, the system reaches the desired operating point in less than 50s, overshoots, and then oscillates slightly about the final point. This behavior is analogous to an under-damped second order linear controller. These analogies are helpful in understanding how to optimize the controller response, but not necessarily completely accurate since there is no particular reason for the highly non-linear network to emulate a secondorder system.

Figure 11:
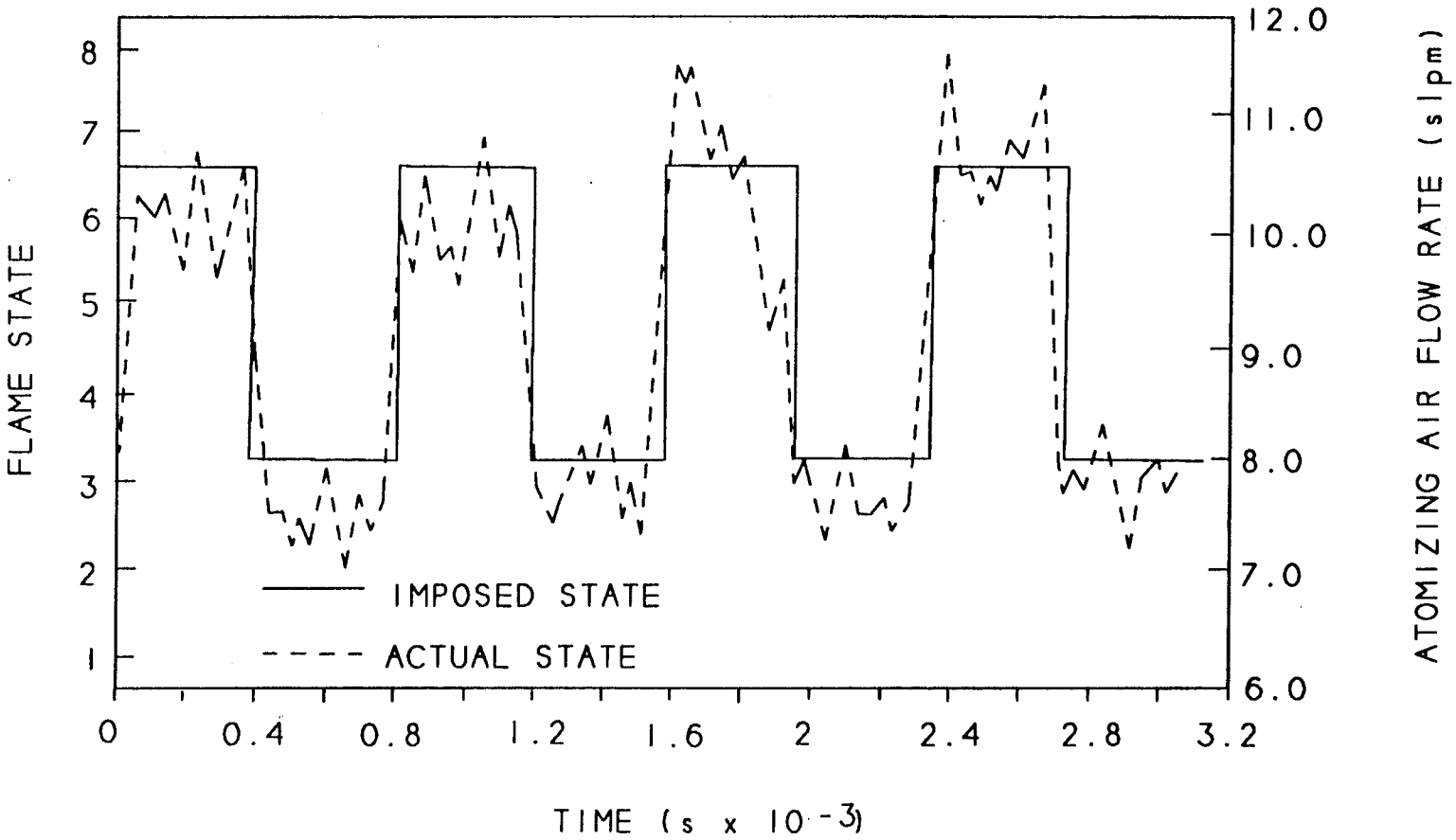
FIG. 11 is a graph of the system closed loop response to a cyclic step function input.

An example of where this simple second order system analogy appears to breakdown is shown in FIG. 11, a plot of the closed-loop response to cyclical step functions between states 3 and 6. The system gain was set to 0.4 and 4 samples of the neural network output were averaged in a running mean of the identified state. The controller successfully guides the burner through the imposed state excursions with a rapid response time and an average error of less than one state. The analogy of the system response to a linear system tends to be insufficient to explain the behavior of the system through the constant plateaus of the square wave pattern. Indeed, one-half flame state fluctuations persist throughout the 400s stable state plateaus. One possible explanation is limit cycling due to the non-linearities in both the combustion process and the neural network processing. However, there does not seem to be any regularity to the fluctuations. This may be due to the turbulent and very noisy plant fluctuations.

Given the novel concept for the controller and the lack of any dynamic tuning of the neural network itself, the accuracy of the system's response was extraordinary. The small oscillations about the stable plateaus could easily be removed by simply gain scheduling, where the gain is set to some lower value or zero if the identified state differs from the desired state by less than one state. Other, rule based, control algorithm adjustments could also be imposed, such as requiring that the difference between the identified state and the desired state remain of the same sign for two consecutive samples before implementing a control decision.

Figure 12:
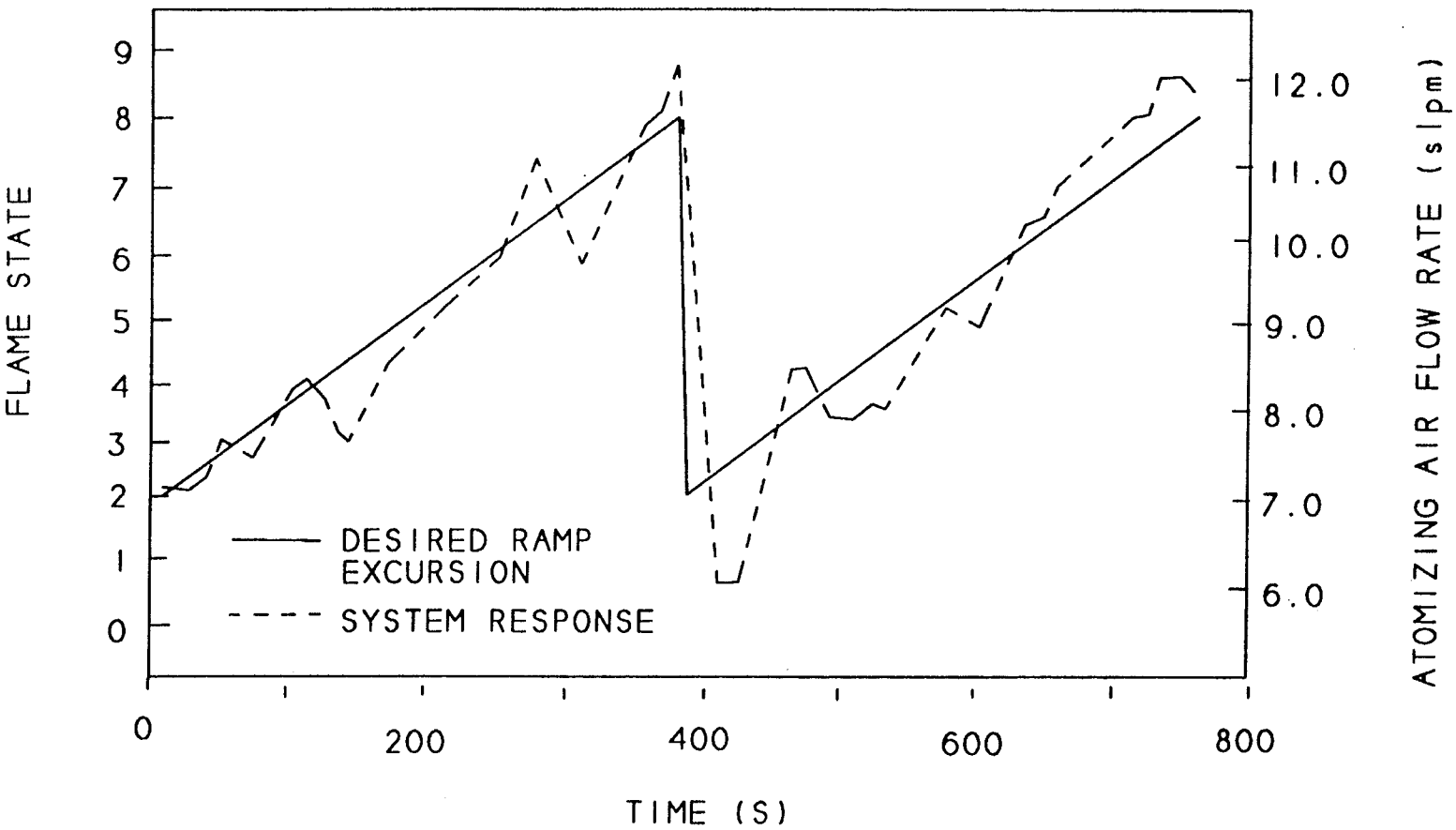
FIG. 12 is a graph of the system closed loop response to a linear ramp input change.

A final series of tests were performed exploring the system's response to a series of imposed ramp excursions. These test are more representative of an actual boiler controller sequence driving the combustor smoothly over a range of energy release rates. An example series of two sequences is shown in FIG. 12, where the gain was again set at 0.4 and 4 samples were averaged in a running mean. The imposed ramp encompasses nearly the entire stable operating range of the system (recall that flame state 0 represents no flame). The stability of the controller in maintaining a continuous ramp function is somewhat higher than its ability to maintain a steady level. This result is not intuitive, but expedient since simple gain scheduling adjustments for the static stability are more difficult to implement for dynamic responses.

The demonstration program described herein resulted in the first combustion control system relying entirely upon imaging sensor input and neural network processing. Apart from the control demonstration experiments, the integration and operation of a real-time, neural network-based image acquisition and processing computer environment is a significant accomplishment in the application of these state-of-the-art technologies to practical industrial problems. Having illustrated and described the principles of the invention with respect to a preferred embodiment thereof, it will be apparent to those skilled in the art that the invention may be modified in arrangement and detail such as by increasing the sophistication and complexity of the neural network, using faster computer processing equipment, or by implementing multiple neural networks into a single controller, without departing from the scope and principles of the invention.

We claim:

1. A combustion control system for regulating the delivery of fuel and air to a combustor comprising:

a. a gated, freeze-frame, intensified charged coupled device imaging camera directed at the flame of the combustor and capable of determining the quantity and location of particular radicals generated by the combustion process said quantity and location of particular radicals being indicative of flame quality;

b. a neural network for receiving said quantity and location information from said imaging camera and for recognizing spatial and qualitative patterns of said information wherein said patterns are indicative of flame quality and for producing a neural network output signal representative of flame quality;

c. a controller for receiving said neural network output signal and producing a control output signal tending to improve flame quality; and d. a control element for controlling fuel air ratio in response to said control output signal whereby fuel air ratio is controlled to optimize flame quality in said combustor for varying loads on said combustor.

2. A combustion control system as recited in claim 1 wherein said radicals are OH radicals.

3. A combustion control system as recited in claim 1 wherein said radicals are CH radicals.

4. A combustion monitoring system as recited in claim 1 wherein said radicals are selected from the group of NO, CO, $CO_2$, $H_2O$, and trace pollutants.

5. A combustion control system as recited in claim 1 wherein said neural network further comprises an input layer receiving information from said imaging camera, a hidden layer with adjustable weighting values and an output layer.

6. A combustion control system as recited in claim 1 further comprising a pre-processor for receiving said quantity and location information from said imaging camera and relating said data to a particular position relative to said spatial and qualitative patterns and sending said information to said neural network.

7. A combustion control system as recited in claim 6 wherein said particular position is the centroid of said flame pattern.

8. A combustion control system as recited in claim 1 wherein said control element further comprises a fuel flow control valve.

9. A combustion control system as recited in claim 1 wherein said control element further comprises a coal weigh feeder.

10. A combustion control system as recited in claim 1 wherein said control element further comprises an air flow control device.

11. A combustion control system as recited in claim 5 wherein said pre-processor further comprises a video image frame grabber.

12. A combustion control system as recited in claim 5 wherein said control system can be adaptively retrained in operation.

13. A combustion control systems as recited in claim 1 wherein control output signal is directly formulated by the neural network.

14. A combustion monitoring system for determining the quality of a combustor which comprises:

a) a gated, freeze-frame, intensified charged coupled device imaging camera directed at the flame of the combustor and capable of determining the quantity and location of particular radicals generated by the combustion process said quantity and location of particular radicals being indicative of flame quality;

b) a neural network for receiving said quantity and location information from said imaging camera and for recognizing spatial and qualitative patterns of said information wherein said patterns are indicative of flame quality and for producing a neural network output signal representative of flame quality; and c) a display device for receiving said output of said neural network and displaying information indicative of flame quality.

15. A combustion monitoring system as recited in claim 14 wherein said radicals are OH radicals.

16. A combustion monitoring system as recited in claim 14 wherein said radicals are CH radicals.

17. A combustion monitoring system as recited in claim 14 wherein said radicals are selected from the group of NO, CO, $CO_2$, $H_2O$, and trace pollutants.

18. A combustion monitoring system as recited in claim 14 wherein said neural network further comprises an input layer receiving information from said imaging camera, a hidden layer with adjustable weighting values and an output layer.

19. A combustion monitoring system as recited in claim 14 further comprising a pre-processor for receiving said quantity and location information from said imaging camera and relating said data to a particular position relative to said spatial and qualitative patterns and sending said information to said neural network.

20. A combustion monitoring system as recited in claim 19 wherein said particular position is the centroid of said flame pattern.

21. A combustion monitoring system as recited in claim 14 wherein said pre-processor further comprises a video image frame grabber.

22. A combustion monitoring system as recited in claim 14 wherein said monitoring system can be adaptively retrained in operation.

23. A combustion monitoring systems as recited in claim 14 wherein monitoring output signal is directly formulated by the neural network.

24. A method of controlling combustion in a combustor which comprises:

a. producing an image of the flame with a gated, freeze-frame, intensified charged coupled device camera capable of determining the quantity and location of particular radicals generated by the combustion process said quantity and location being indicative of flame quality;

b. generating a set of images containing information on the quantity and location of particular radicals for known flame quality states;

c. comparing said flame image to said set of flame images;

d. determining the quality of said flame from said comparison; and e. regulating the fuel air ratio of said combustor in response to said determination to improve said flame quality.

25. A method of monitoring combustion in a combustor which comprises:

a. producing an image of the flame with a gated, freeze-frame, intensified charged coupled device camera capable of determining the quantity and location of particular radicals generated by the combustion process said quantity and location being indicative of flame quality;

b. generating a set of images containing information on the quantity and location of particular radicals for known flame quality states;

c. comparing said flame image to said set of flame images;

d. determining the quality of said flame from said comparison; and e. displaying an indication of said flame quality.

* * * * *